US009550369B2

(12) United States Patent
Nakata

(10) Patent No.: US 9,550,369 B2
(45) Date of Patent: Jan. 24, 2017

(54) RECORDING DEVICE

(71) Applicant: SEIKO EPSON CORPORATION, Tokyo (JP)

(72) Inventor: Toshio Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/660,985

(22) Filed: Mar. 18, 2015

(65) Prior Publication Data

US 2015/0266309 A1 Sep. 24, 2015

(30) Foreign Application Priority Data

Mar. 20, 2014 (JP) ..... 2014-057879

(51) Int. Cl.
*B41J 2/17* (2006.01)
*B41J 2/215* (2006.01)
*B41J 29/377* (2006.01)

(52) U.S. Cl.
CPC ..... *B41J 2/215* (2013.01); *B41J 2/1714* (2013.01); *B41J 29/377* (2013.01)

(58) Field of Classification Search
CPC ..... B41J 2/1714; B41J 2/18; B41J 2/08; B41J 2/16517; B41J 2/215; B41J 29/377
USPC ..... 347/34
See application file for complete search history.

(56) References Cited

U.S. PATENT DOCUMENTS 4,369,450 A * 1/1983 Iwagami et al. ..... 347/34
5,774,141 A * 6/1998 Cooper ..... B41J 2/1714 347/34
6,203,152 B1 * 3/2001 Boleda ..... B41J 29/377 347/102
6,378,986 B2 * 4/2002 Van De Kruys ..... 347/49
7,604,332 B2 * 10/2009 Nagashima ..... 347/84
8,308,284 B2 * 11/2012 Kanada ..... 347/102
8,356,881 B2 * 1/2013 Ohnishi ..... 347/34
9,050,812 B2 * 6/2015 Tanaka
2003/0067505 A1 * 4/2003 Kumagai ..... B41J 2/16508 347/35
2004/0151528 A1 * 8/2004 Terry ..... B41J 29/377 400/693
2005/0248646 A1 11/2005 Morris et al.
2011/0109693 A1 * 5/2011 Ohnishi ..... B41J 2/18 347/34
2011/0310172 A1 * 12/2011 Miyata ..... B41J 2/1714 347/34
2012/0001985 A1 * 1/2012 Kumagai ..... 347/34
(Continued)

FOREIGN PATENT DOCUMENTS

JP 2005 205766 8/2005
JP 2005205766 A * 8/2005
(Continued)

OTHER PUBLICATIONS

European Search Report for Application No. 15159608.7 dated Jul. 16, 2016.

*Primary Examiner* — Matthew Luu
*Assistant Examiner* — Patrick King
(74) *Attorney, Agent, or Firm* — Workman Nydegger

(57) ABSTRACT

A recording device includes a base body, an air current generator that is disposed in the base body, and a duct that has an opening and configures an air current flow path formed from the opening to the air current generator. The duct is attachable to and detachable from the base body.

6 Claims, 19 Drawing Sheets

(56) References Cited

U.S. PATENT DOCUMENTS

2014/0225959 A1* 8/2014 Kobayashi et al. ..... 347/34

FOREIGN PATENT DOCUMENTS

| | | |
|---|---|---|
| JP | 2009-172937 | 8/2009 |
| JP | 2010-058441 | 3/2010 |
| JP | 2010 058441 | 3/2010 |

* cited by examiner

RECORDING DEVICE

BACKGROUND

1. Technical Field

The present invention relates to a recording device.

2. Related Art

In the related art, a recording device has been used which includes an air current generator for moving foreign substances such as ink mist. For example, JP-A-2010-58441 and U.S. Pat. No. 5,774,141 disclose a recording device which includes a duct configuring a flow path for air current and a filter for capturing foreign substances such as ink mist.

However, in the recording device of the related art which has the air current generator, the duct, and the filter as disclosed in JP-A-2010-58441 and U.S. Pat. No. 5,774,141, in some cases, the foreign substances such as the ink mist are accumulated not only in the filter but also inside the duct, and the foreign substances accumulated inside the duct fall and adhere to a recording medium, thereby causing the recording medium to become dirty.

SUMMARY

Therefore, an advantage of some aspects of the invention is to prevent a recording medium from becoming dirty in a recording device including an air current generator for moving foreign substances such as ink mist.

According to an aspect of the invention, there is provided a recording device including a base body, an air current generator that is disposed in the base body, and a duct that has an opening and configures an air current flow path formed from the opening to the air current generator. The duct is attachable to and detachable from the base body.

The recording device may further include a filter that is disposed between the opening and the air current generator. Preferably, the filter is attachable to and detachable from the base body.

In the recording device, a configuration may be adopted in which the duct can be detached from the base body prior to the filter.

In the recording device, a configuration may be adopted in which the filter can be detached from the base body prior to the duct.

In the recording device, a configuration may be adopted in which the duct and the filter can be concurrently detached from the base body.

In the recording device, a configuration may be adopted in which the base body has a nozzle forming surface which ejects an ink onto a recording medium, and in which the opening is configured to be flush with the nozzle forming surface.

The recording device may further include a pressure detector that is disposed between the filter and the air current generator.

According to the aspect of the invention, if foreign substances such as ink mist are accumulated in a duct, cleaning or replacement can be performed by detaching the duct from a base body. Therefore, it is possible to prevent a recording medium from becoming dirty due to the foreign substances adhering to the recording medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording device according to an embodiment of the invention will be described in detail with reference to the accompanying drawings.

Embodiment 1 (FIGS. 1 to 16)

First, an overview of a recording device according to Embodiment 1 of the invention will be described.

Figure 1:
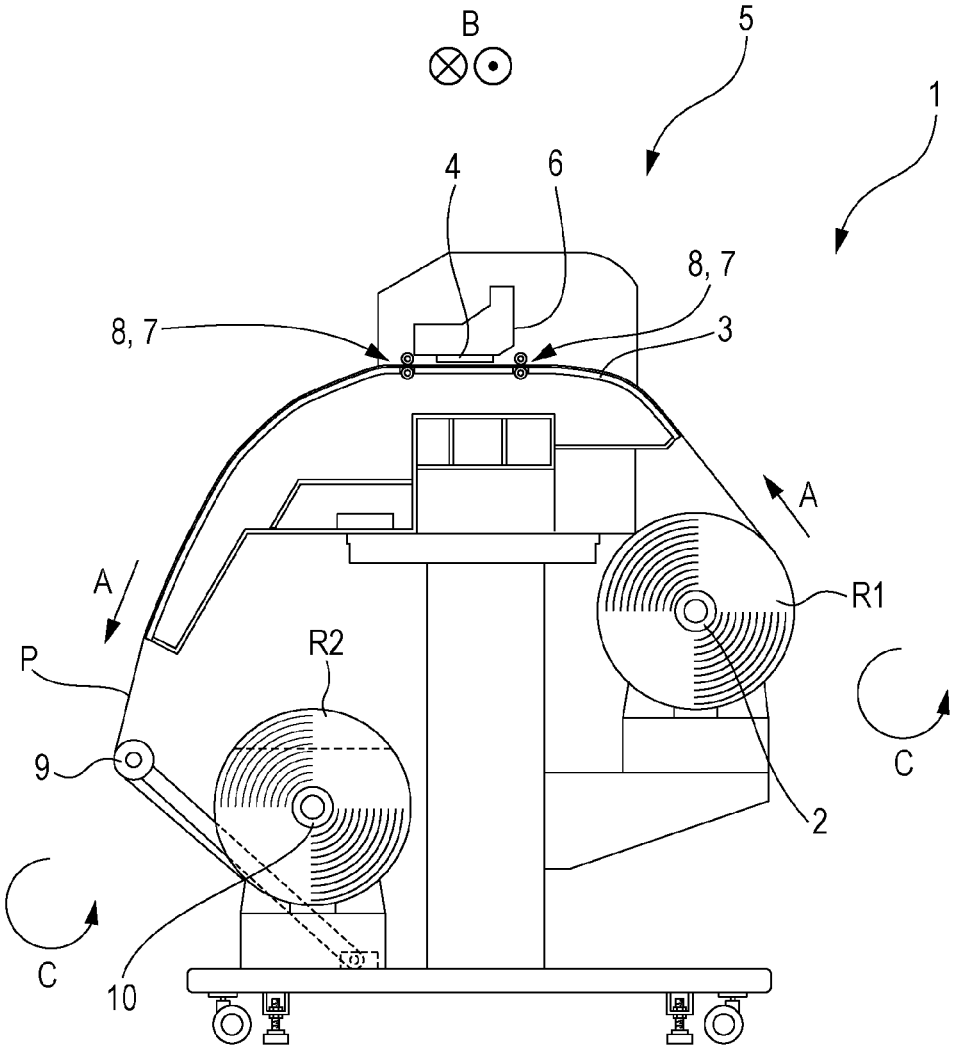
FIG. 1 is a schematic side view illustrating a recording device according to Embodiment 1 of the invention.

FIG. 1 is a schematic side view of a recording device 1 according to the present embodiment.

The recording device 1 according to the embodiment includes a support shaft 2 which supports a roll R1 of a roll-shaped recording medium P for recording. Then, in the recording device 1 according to the embodiment, the support shaft 2 rotates in a rotation direction C when the recording medium P is transported in a transport direction A. The embodiment employs the roll-type recording medium P wound so that a recording surface thereof faces outward. However, when the roll-type recording medium P wound so that the recording surface faces inward is employed, the roll R1 can be fed by being rotated in a direction opposite to the rotation direction C of the support shaft 2.

The recording device 1 according to the embodiment employs a roll-type recording medium as the recording medium P. However, the invention is not limited to the recording device which employs the roll-type recording medium as described above. For example, a single sheet-type recording medium may be employed.

The recording device 1 according to the embodiment includes a transport mechanism 7 which has a transport roller pair 8 for transporting the recording medium P in the transport direction A.

A heater (not illustrated) which can heat the recording medium P supported by a medium support section 3 is disposed below the medium support section 3. In this way, the recording device 1 according to the embodiment includes the heater which can heat the recording medium P from the medium support section 3 side. However, the recording device 1 may include an infrared heater to be disposed at a position opposing the medium support section 3. In a case of using the infrared heater, a preferred wavelength of infrared rays is 0.76 μm to 1000 μm. In general, infrared rays are classified into near infrared rays, mid-infrared rays, and far infrared rays. Although the classification is defined in various ways, approximate wavelength ranges are respectively 0.78 μm to 2.5 μm, 2.5 μm to 4.0 μm, and 4.0 μm to 1000 μm. Among them, it is preferable to employ the mid-infrared rays.

The recording device 1 according to the embodiment includes a recording mechanism 5 which performs recording by ejecting an ink through nozzles of a nozzle forming surface having multiple nozzles disposed thereon while causing a recording head 4 serving as a recording unit mounted on a carriage 6 to perform reciprocating scanning in a direction B intersecting the transport direction A of the recording medium P.

The carriage 6 according to the embodiment includes a mist collector 25 (refer to FIG. 3) which collects ink mist generated when the ink is ejected through the recording head 4. Details thereof will be described later.

A winding shaft 10 which can wind the recording medium P as a roll R2 is provided on a downstream side of the recording mechanism 5 in the transport direction A of the recording medium P. The embodiment employs the roll-type recording medium P wound so that the recording surface faces outward. Accordingly, when the recording medium P is wound, the winding shaft 10 rotates in the rotation direction C. In contrast, in a case of employing the roll-type recording medium P wound so that the recording surface faces inward, the recording medium P can be wound by being rotated in the direction opposite to the rotation direction C.

A contact portion with the recording medium P is disposed to extend in the direction B, and a tension bar 9 which can provide the recording medium P with desired tension is disposed between an end portion on a downstream side in the transport direction A of the recording medium P in the medium support section 3 and the winding shaft 10.

Next, an electrical configuration in the recording device 1 according to the embodiment will be described.

Figure 2:
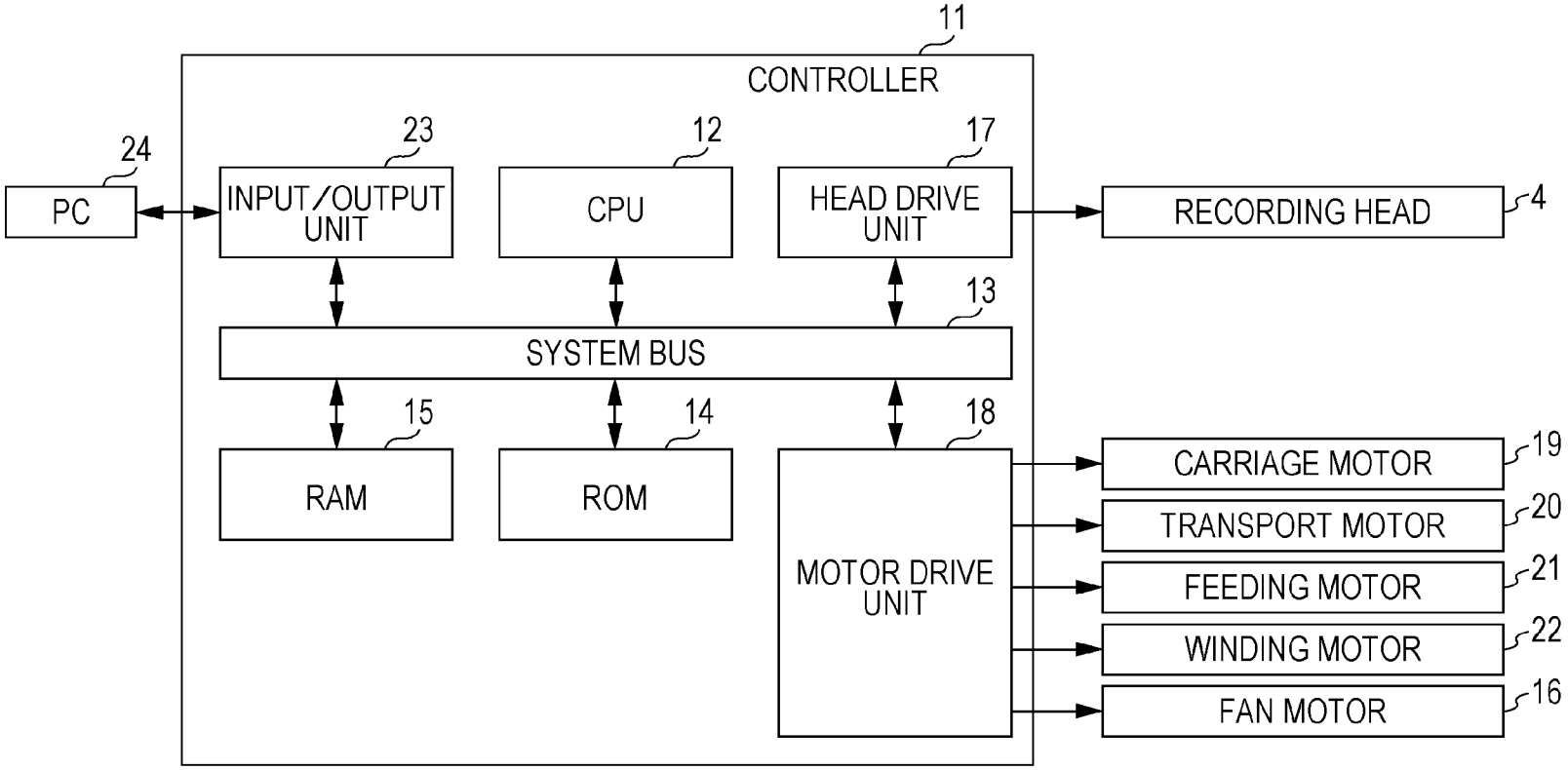
FIG. 2 is a block diagram of the recording device according to Embodiment 1.

FIG. 2 is a block diagram of the recording device 1 according to the embodiment.

A CPU 12 which performs overall control of the recording device 1 is disposed in a controller 11. The CPU 12 is connected via a system bus 13 to a ROM 14 which stores various control programs executed by the CPU 12 and a RAM 15 which can temporarily store data.

The CPU 12 is connected via the system bus 13 to a head drive unit 17 for driving the recording head 4.

The CPU 12 is connected via the system bus 13 to a motor drive unit 18 which is connected to a carriage motor 19, a transport motor 20, a feeding motor 21, a winding motor 22, and a fan motor 16.

Here, the carriage motor 19 is a motor for moving the carriage 6 having the recording head 4 mounted thereon in the direction B. In addition, the transport motor 20 is a motor for driving a transport roller pair 8 disposed in the transport mechanism 7. In addition, the feeding motor 21 is a rotary mechanism of the support shaft 2, and is a motor for driving the support shaft 2 to feed the recording medium P to the transport mechanism 7. In addition, the winding motor 22 is a drive motor for rotating the winding shaft 10. Then, the fan motor 16 is a drive motor for rotating a fan 26 (refer to FIG. 3) of the mist collector 25.

Furthermore, the CPU 12 is connected via the system bus 13 to an input/output unit 23 which is connected to a PC 24 for transmitting and receiving data and a signal of recording data.

Next, the carriage 6 having the mist collector 25 disposed therein and the mist collector 25 will be described.

Figure 3:
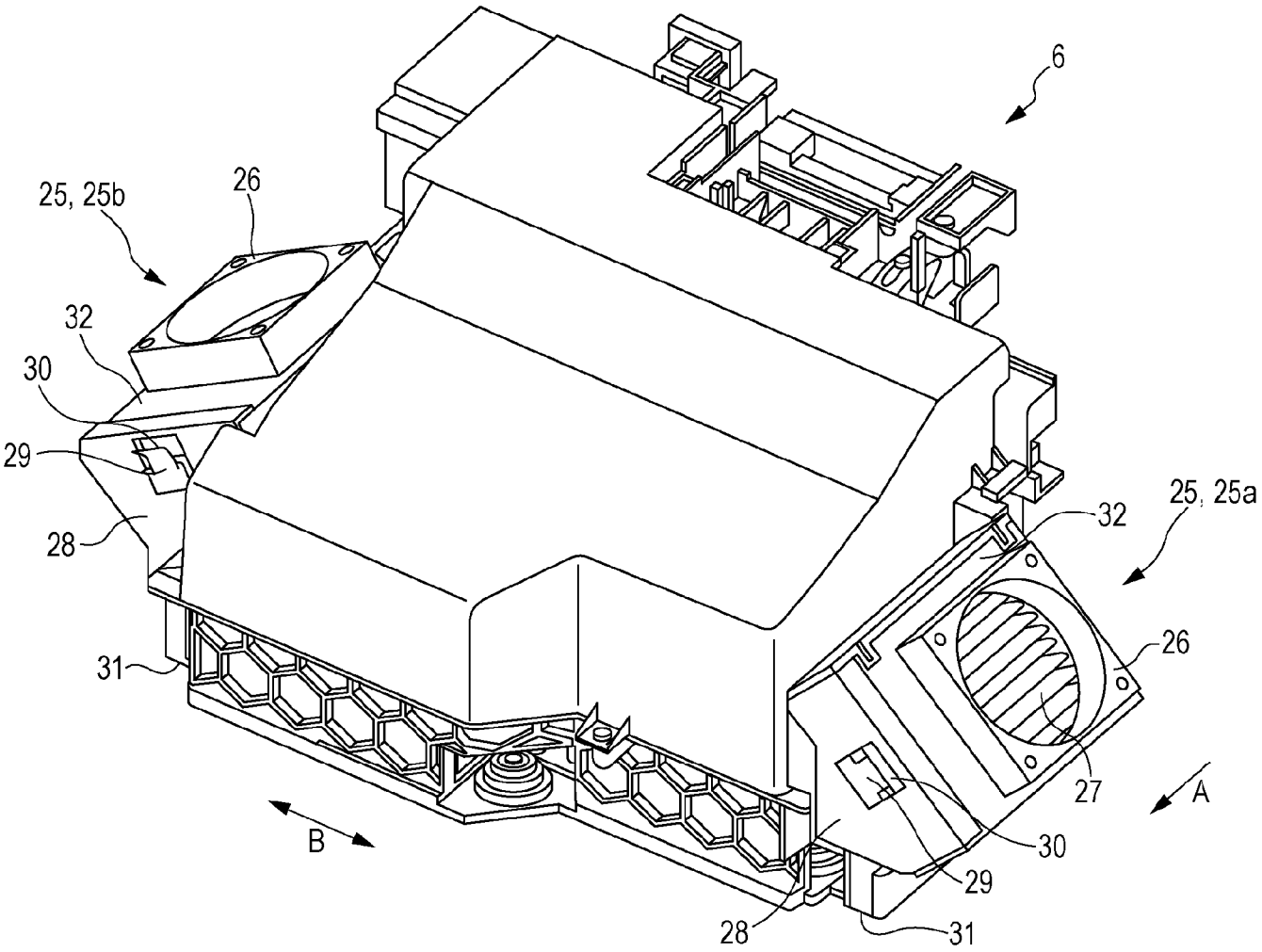
FIG. 3 is a schematic perspective view illustrating a carriage of the recording device according to Embodiment 1.
Figure 4:
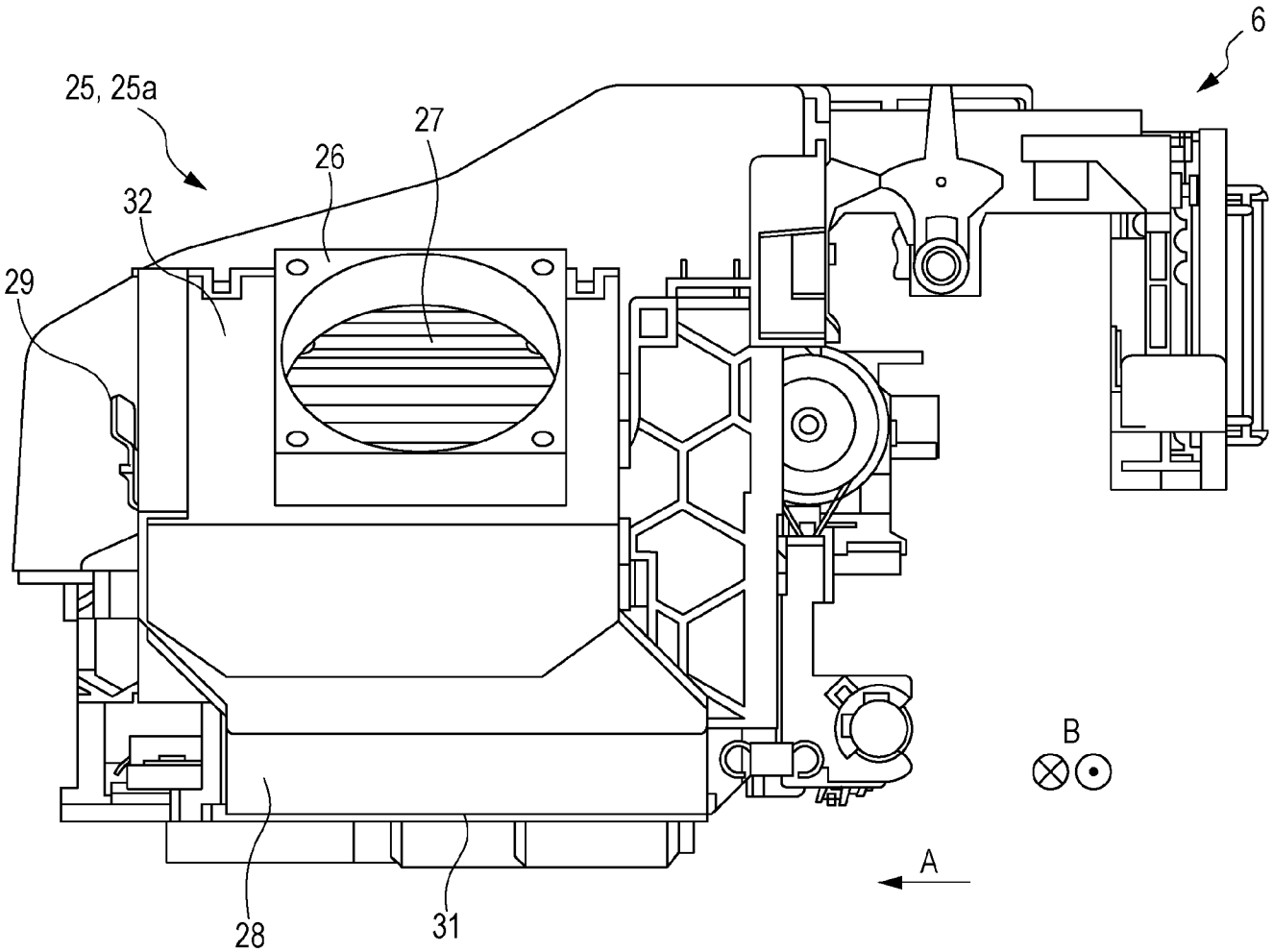
FIG. 4 is a schematic side view illustrating the carriage of the recording device according to Embodiment 1.
Figure 5:
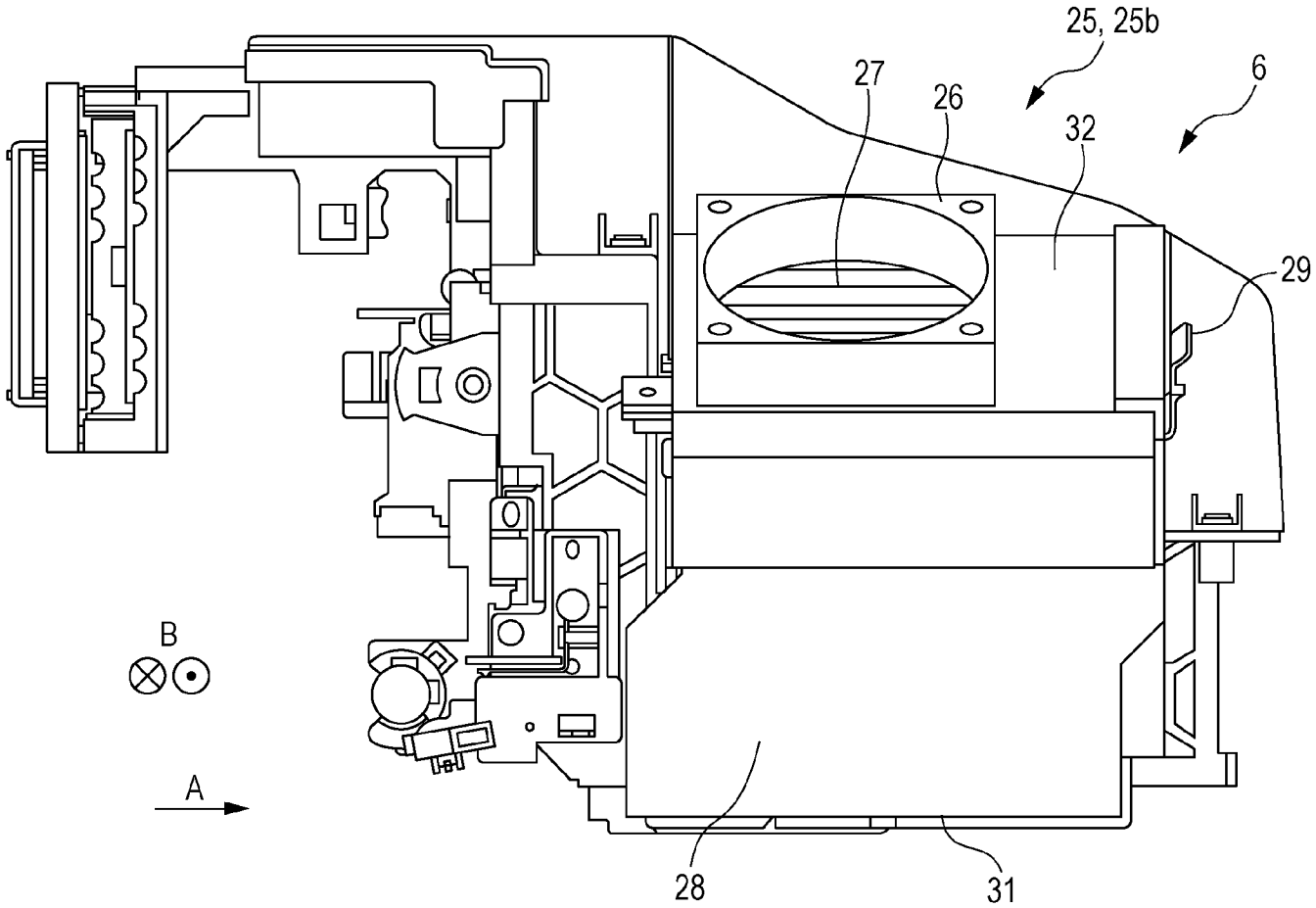
FIG. 5 is a schematic side view illustrating the carriage of the recording device according to Embodiment 1.
Figure 6:
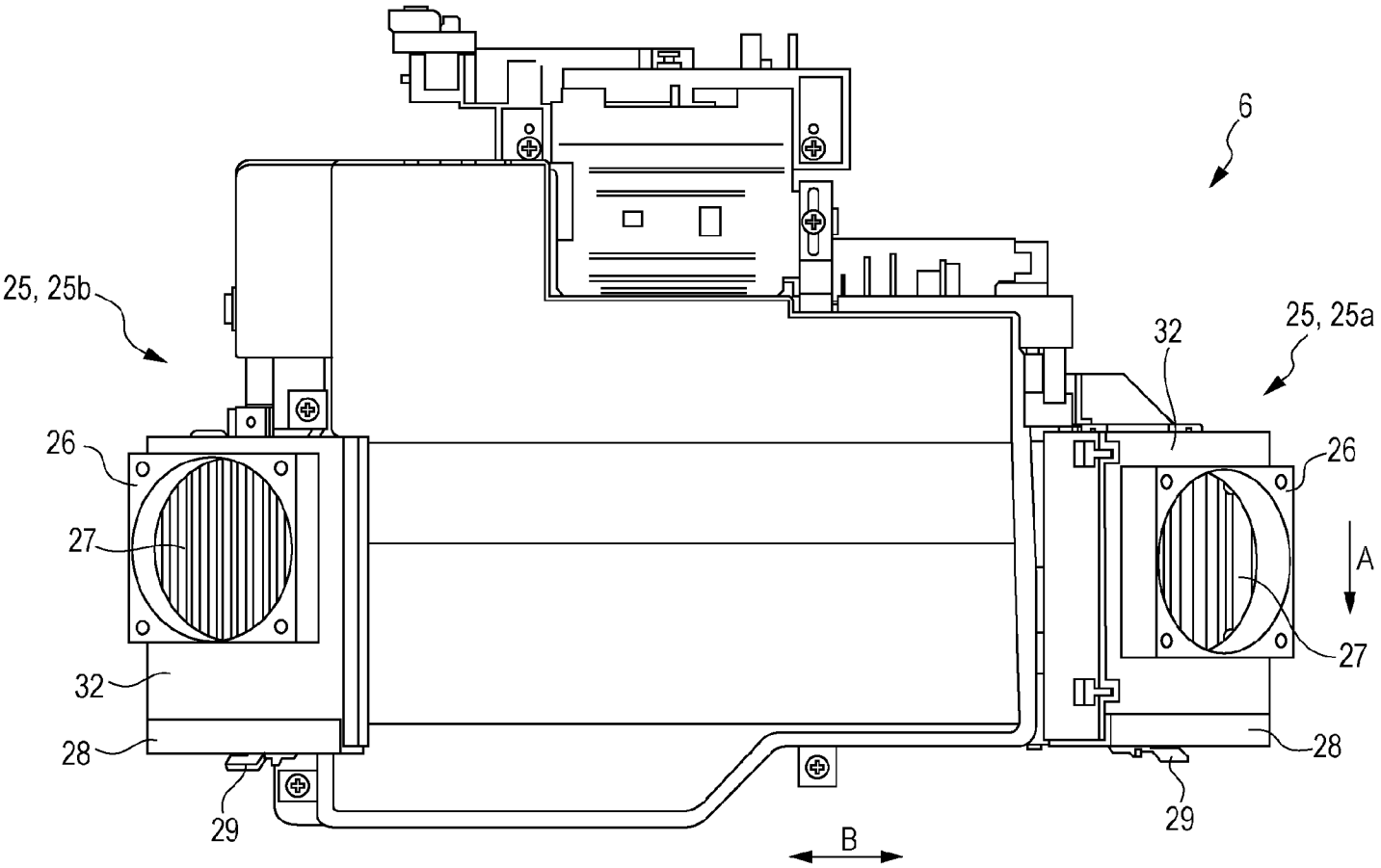
FIG. 6 is a schematic plan view illustrating the carriage of the recording device according to Embodiment 1.
Figure 7:
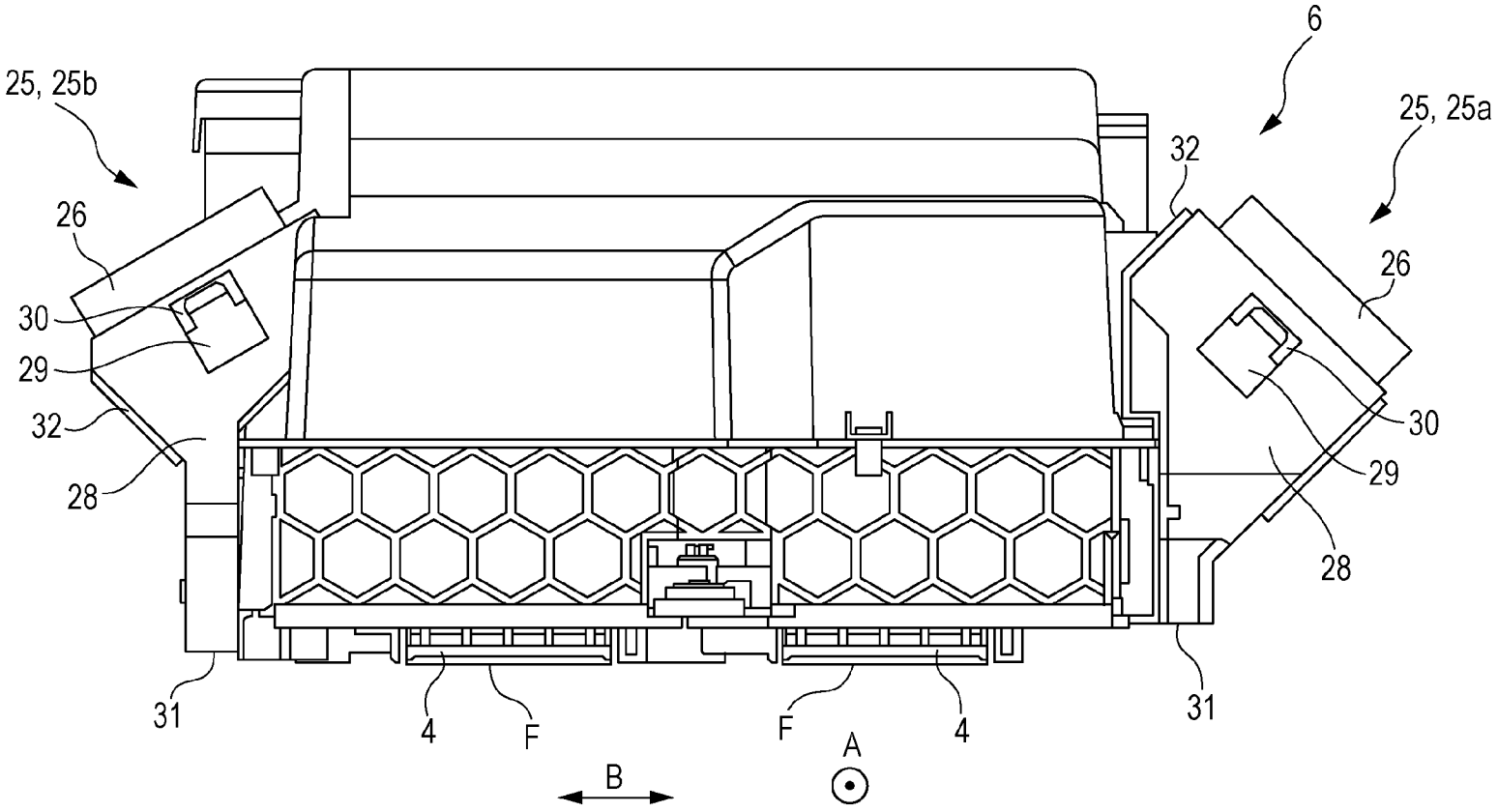
FIG. 7 is a schematic front view illustrating the carriage of the recording device according to Embodiment 1.
Figure 8:
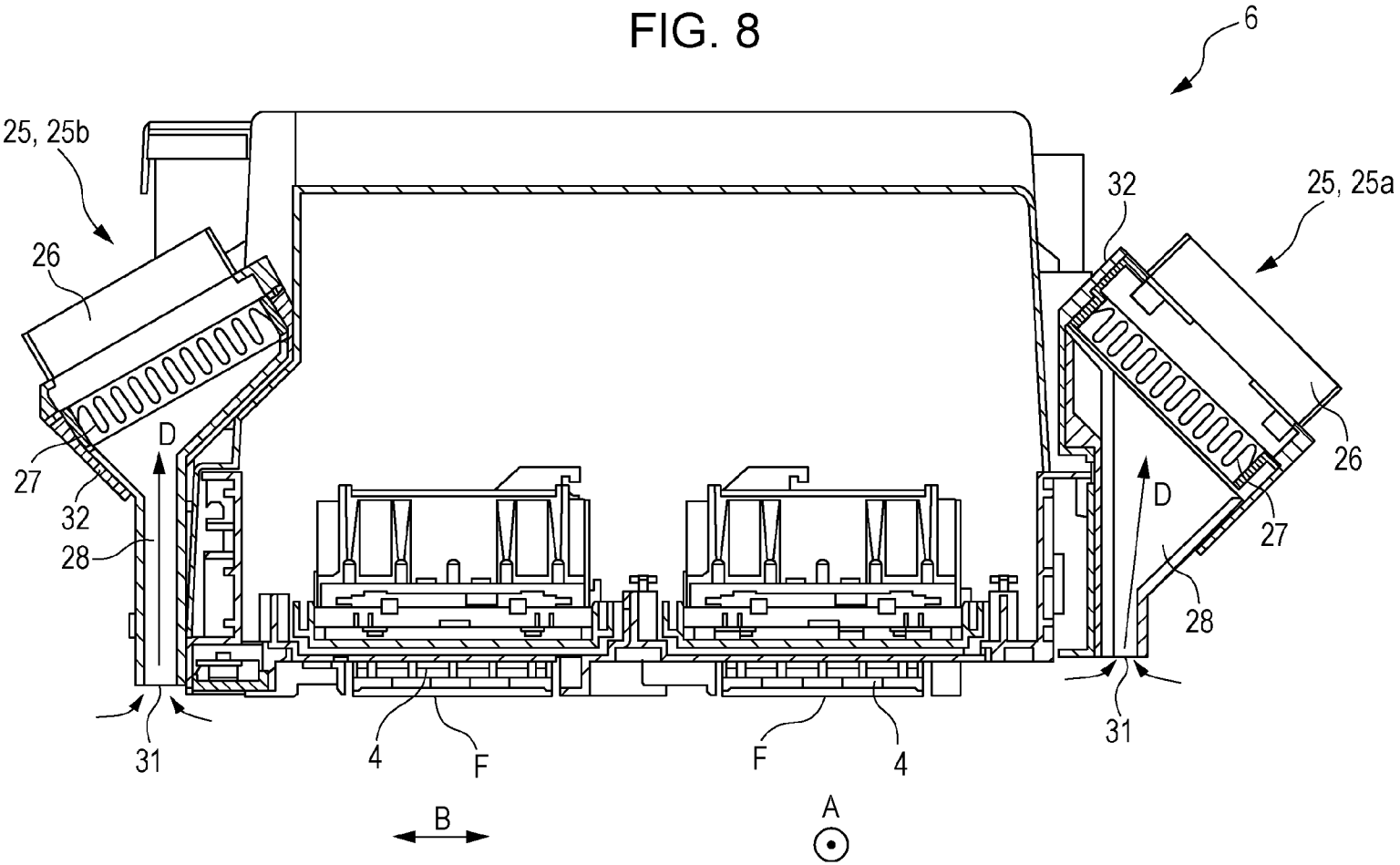
FIG. 8 is a schematic front cross-sectional view illustrating the carriage of the recording device according to Embodiment 1.

FIG. 3 is a schematic perspective view of the carriage 6 according to the embodiment. FIGS. 4 and 5 are schematic side views of the carriage 6 when viewed in respectively different directions. FIG. 6 is a schematic plan view illustrating the carriage 6 according to embodiment. FIG. 7 is a schematic front view of the carriage 6 according to the embodiment. Then, FIG. 8 is a schematic front cross-sectional view of the carriage 6 according to the embodiment.

Figure 9:
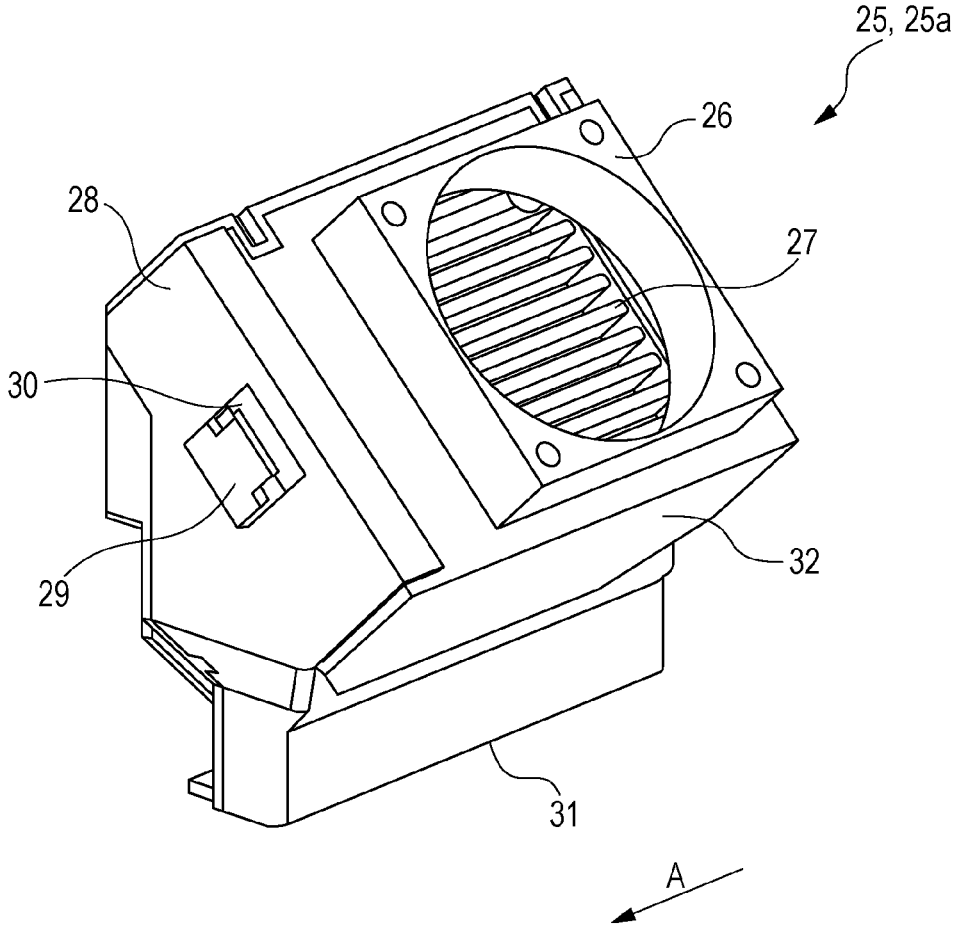
FIG. 9 is a schematic perspective view illustrating a mist collector of the recording device according to Embodiment 1.
Figure 10:
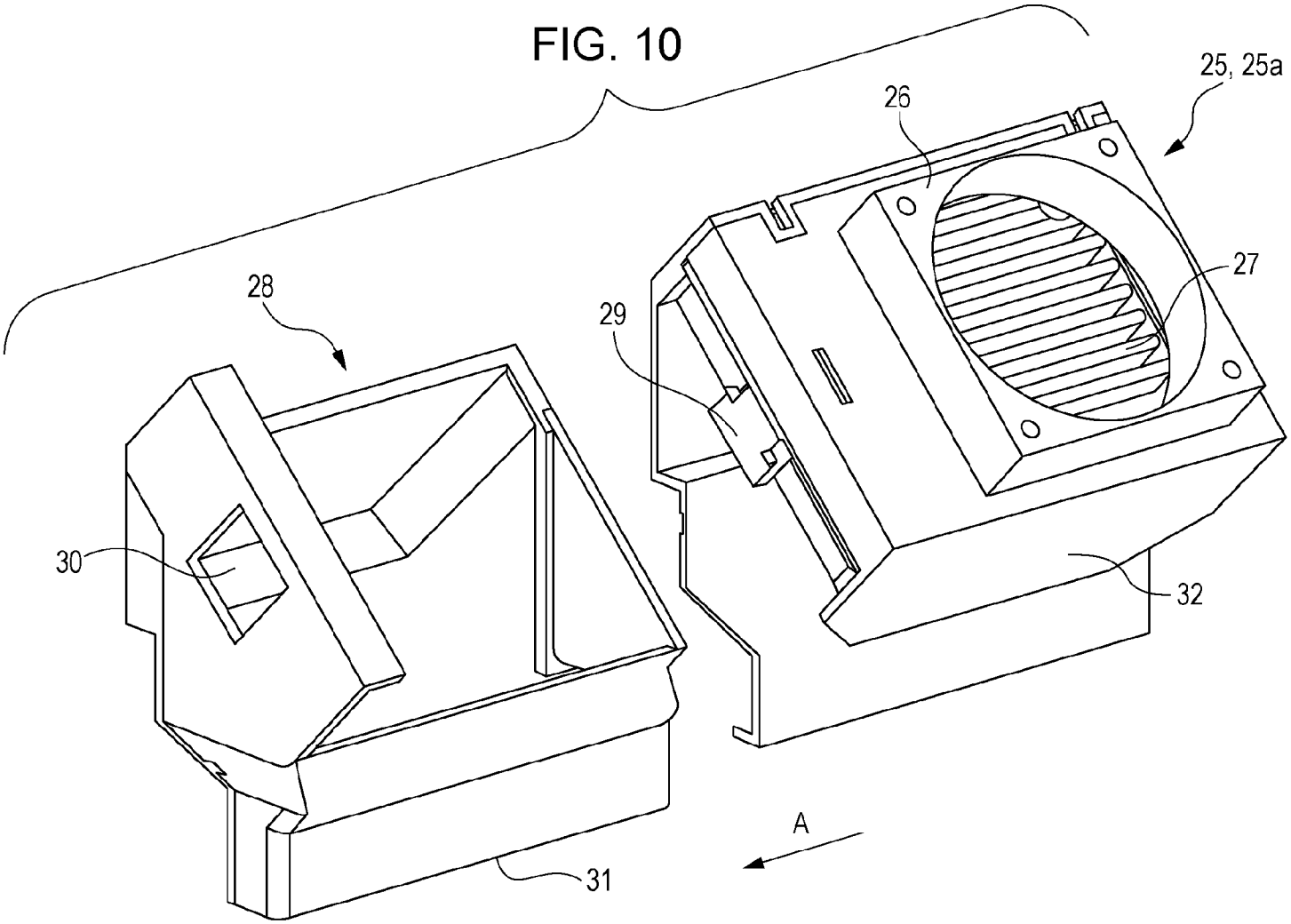
FIG. 10 is a schematic perspective view illustrating the mist collector of the recording device according to Embodiment 1.
Figure 11:
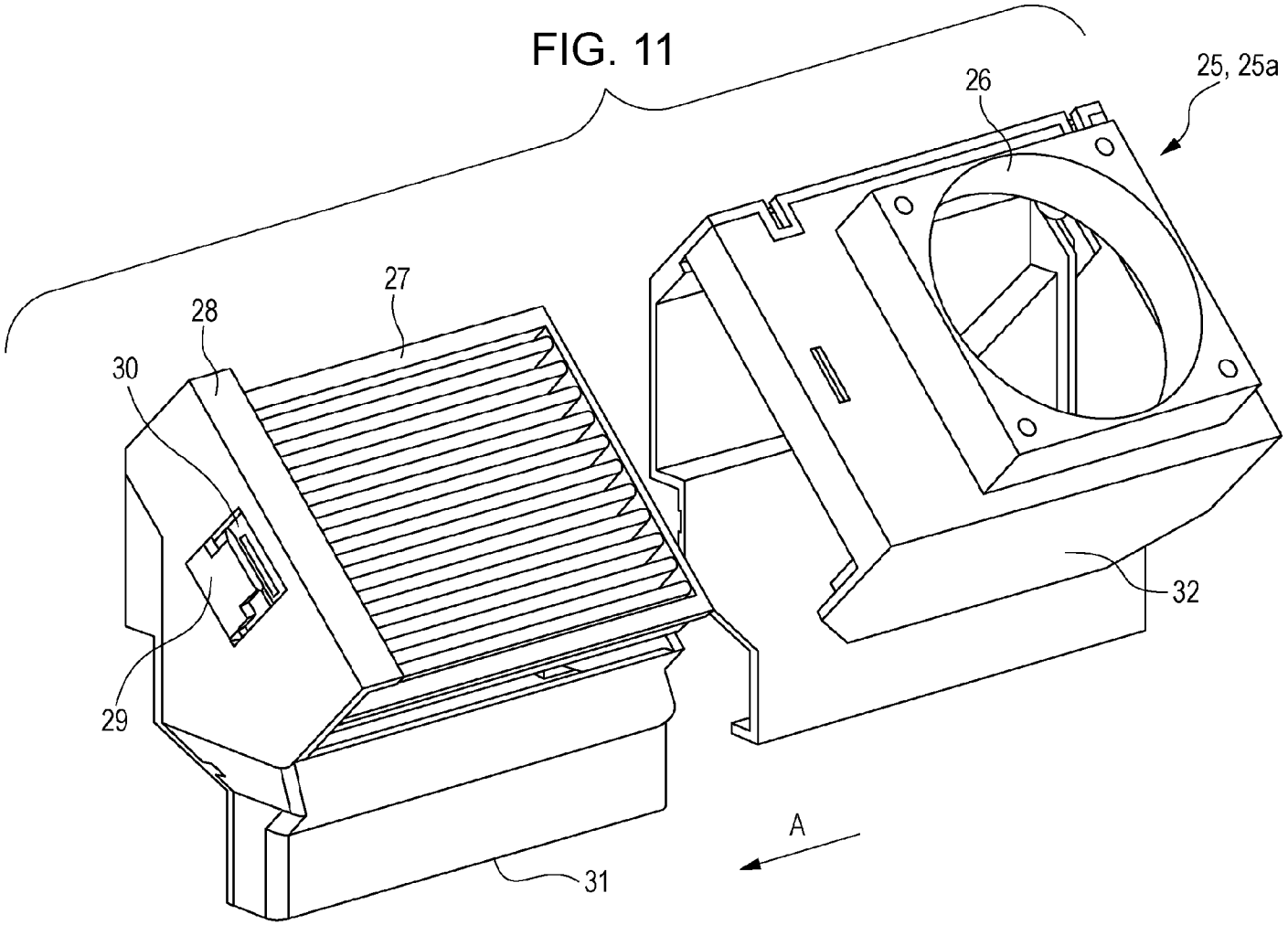
FIG. 11 is a schematic perspective view illustrating the mist collector of the recording device according to Embodiment 1.
Figure 12:
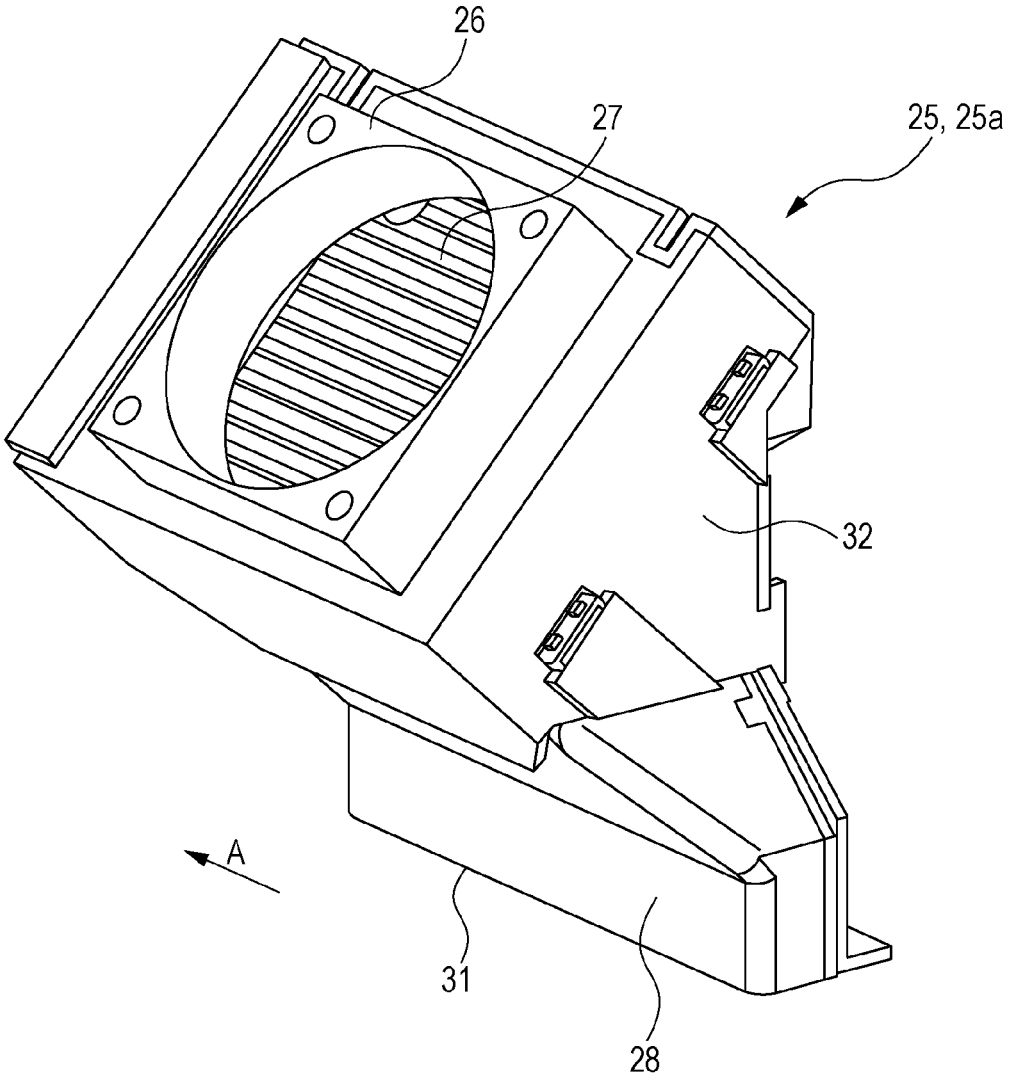
FIG. 12 is a schematic perspective view illustrating the mist collector of the recording device according to Embodiment 1.
Figure 13:
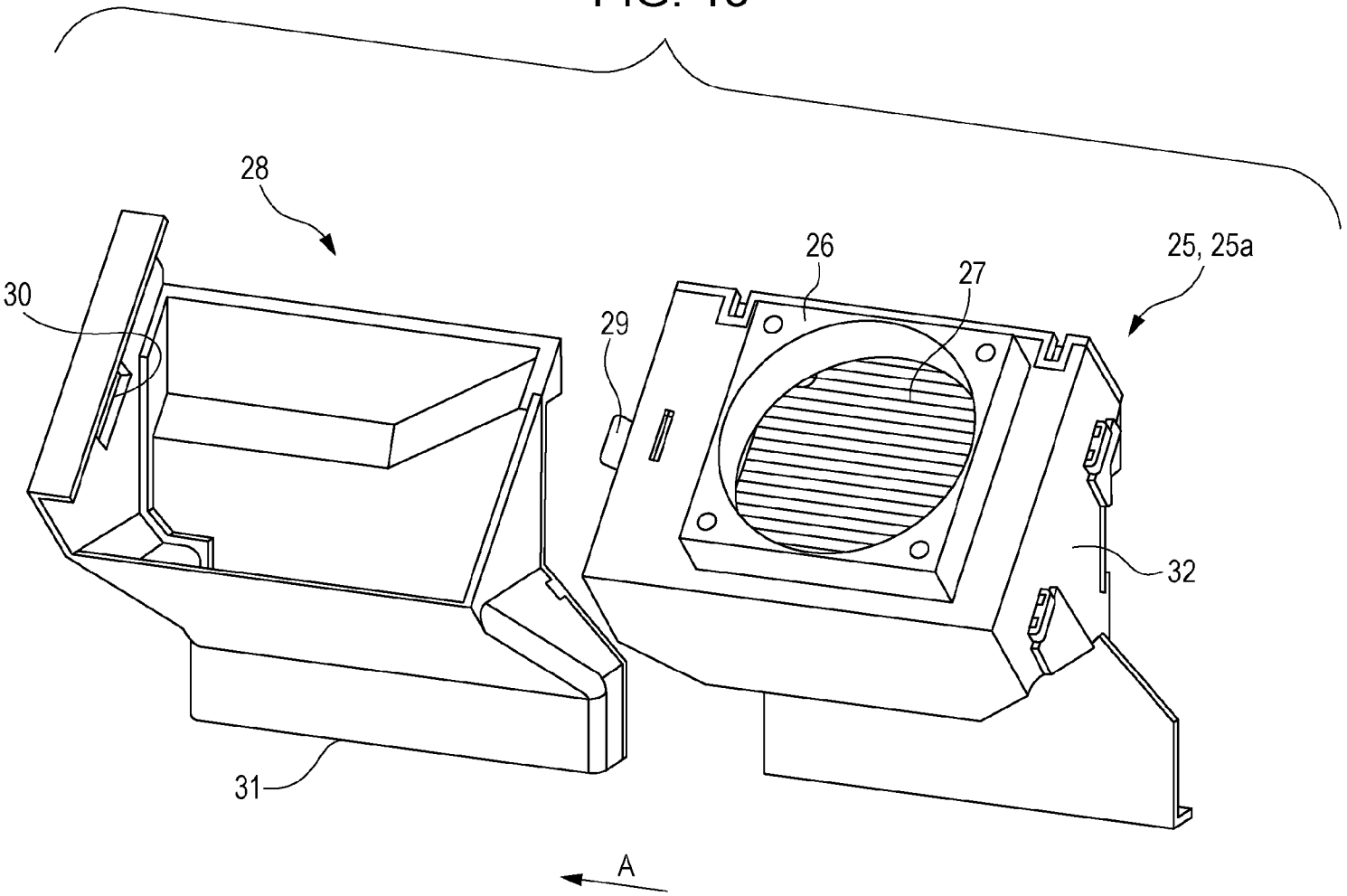
FIG. 13 is a schematic perspective view illustrating the mist collector of the recording device according to Embodiment 1.
Figure 14:
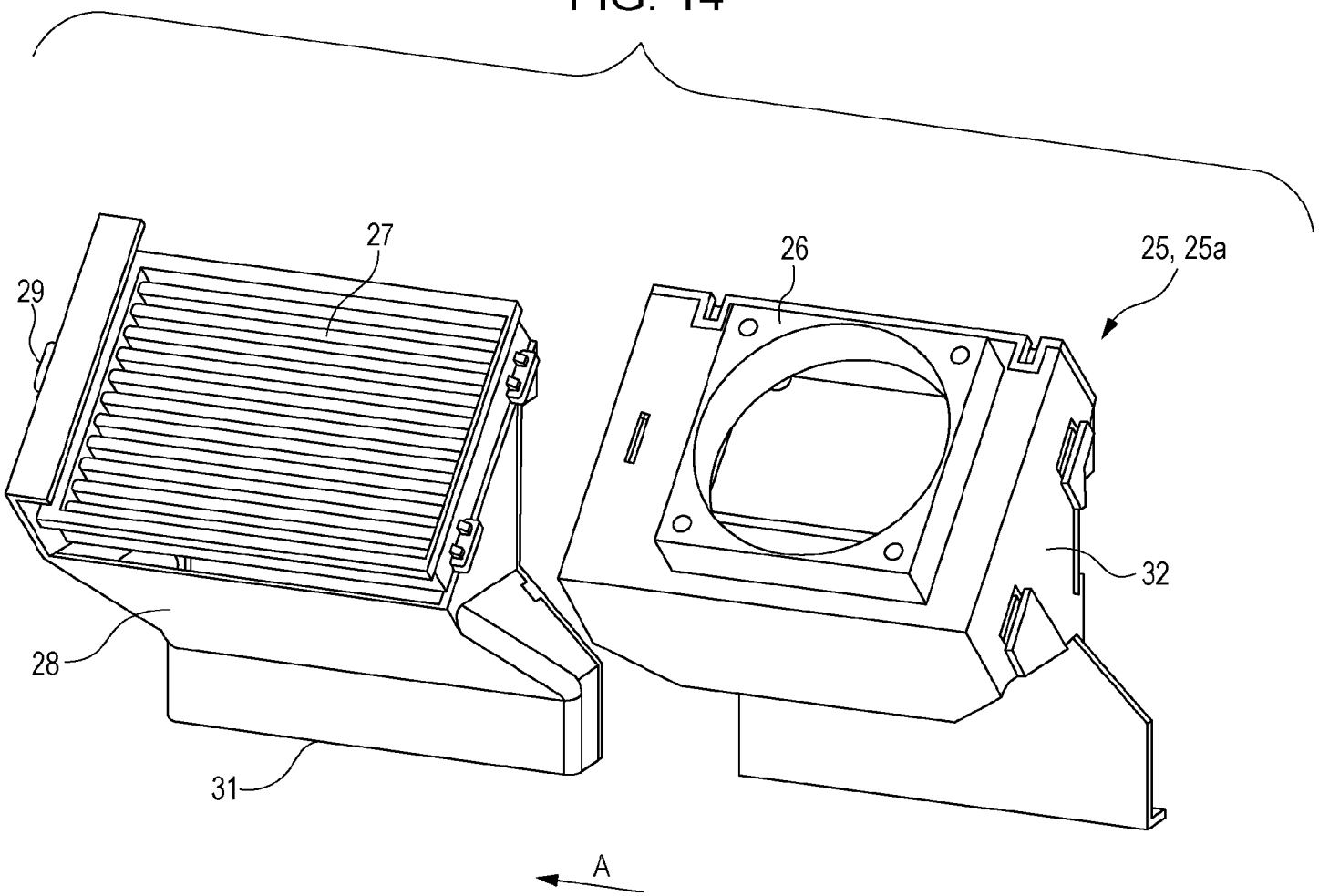
FIG. 14 is a schematic perspective view illustrating the mist collector of the recording device according to Embodiment 1.
Figure 15:
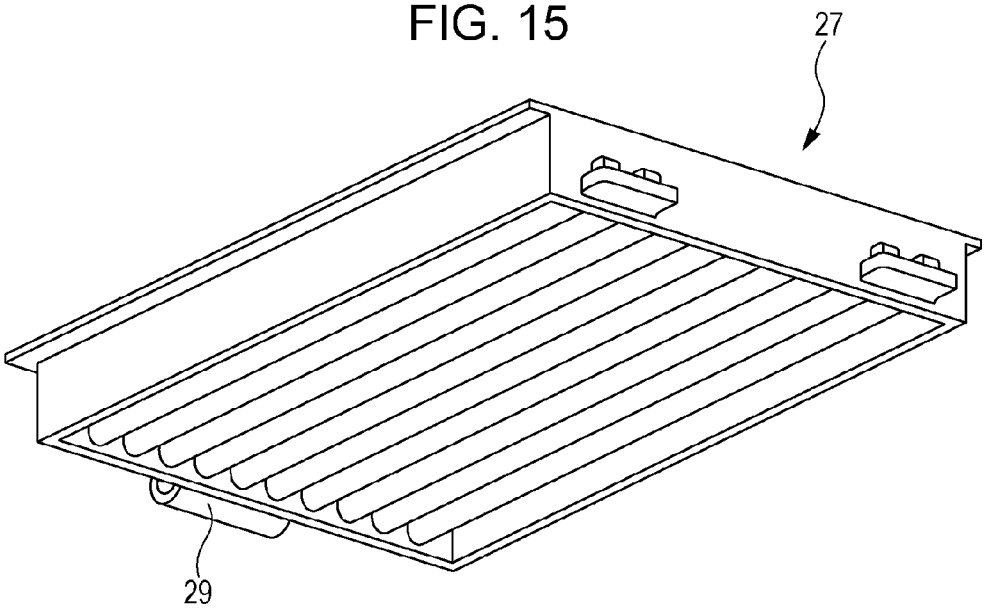
FIG. 15 is a schematic perspective view illustrating a filter of the recording device according to Embodiment 1.
Figure 16:
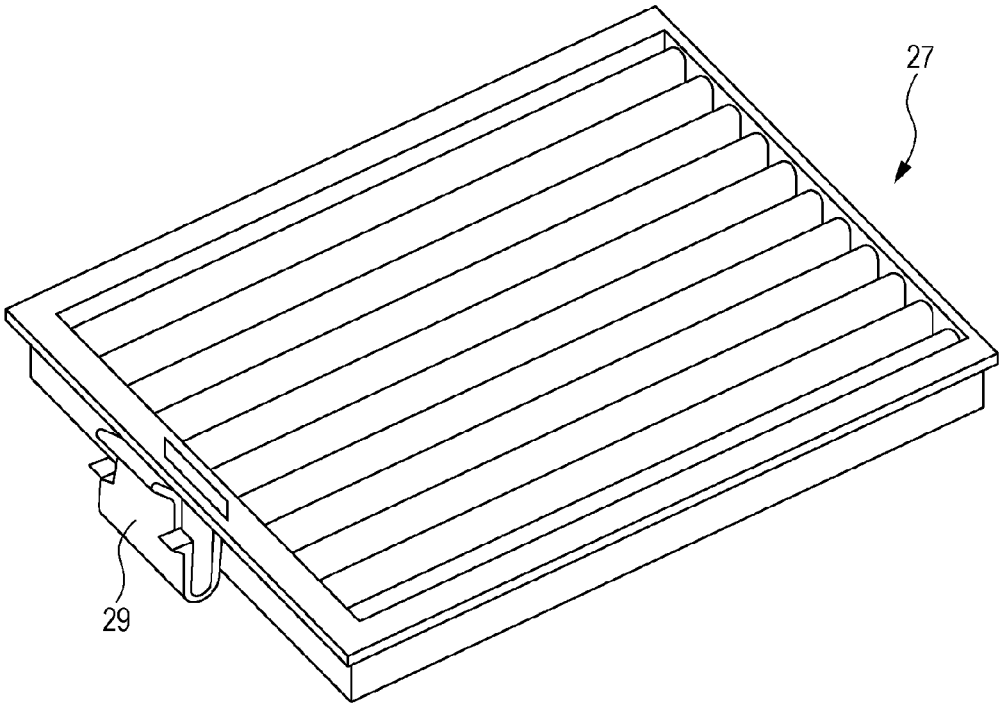
FIG. 16 is a schematic perspective view illustrating the filter of the recording device according to Embodiment 1.

FIGS. 9 to 11 are schematic perspective views of a mist collector 25*a* according to the embodiment. FIGS. 12 to 14 are schematic perspective views of the mist collector 25*a* according to the embodiment when viewed in a direction different from that in FIGS. 9 to 11. Then, FIGS. 15 and 16 are schematic perspective views of a filter 27 when viewed in respectively different directions.

As illustrated in FIGS. 3 to 8, the carriage 6 according to the embodiment has the mist collector 25 (mist collectors 25*a* and 25*b*) disposed in both end portions in the direction B. Both the mist collectors 25*a* and 25*b* have the fan 26 serving as an air current generator, the filter 27 which is attachable to and detachable from a stationary section 32 of the carriage 6 serving as a base body, and a duct 28 which is attachable to and detachable from the stationary section 32.

FIGS. 3 to 14 illustrate the fan 26 by omitting a blade portion thereof.

As illustrated in FIG. 8, the mist collectors 25*a* and 25*b* are configured to be capable of generating air current flowing in the direction B inside the duct 28 using a suction force generated by the fan 26. Then, as illustrated in FIGS. 7 and 8, the duct 28 has an opening 31 arranged at a position which is flush with a nozzle forming surface F of the recording head 4, and is configured to be capable of sucking ambient air through the opening 31. The opening 31 can efficiently suck mist, since a flow path of the duct 28 which is narrowed by the fan 26 increases flow velocity therein.

The mist collectors 25*a* and 25*b* have the same configuration except that shapes of the duct 28 are slightly different from each other.

In the recording device 1 according to the embodiment, the mist collector 25 is disposed in both end portions in the direction B of the carriage 6. Accordingly, irrespective of where the carriage 6 moves in the direction B, the ambient air can be sucked to a downstream side in the movement direction. Therefore, it is possible to efficiently collect ink mist. However, without being limited to this configuration, a configuration may be adopted in which the mist collector 25 is disposed in any one end in the direction B of the carriage 6.

The mist collectors 25*a* and 25*b* are configured so that the filter 27 is arranged in the middle of the air current flow path formed from the duct 28 to the fan 26. Therefore, the filter 27 can collect foreign substances such as ink mist sucked through the opening 31.

As illustrated in FIGS. 11 and 14, the filter 27 according to the embodiment is attachable to and detachable from the stationary section 32 by being slid along the transport direction A. Therefore, the foreign substances collected by the filter 27 can be removed by cleaning the filter 27, and the filter 27 can be easily replaced.

Most of the foreign substances such as the ink mist sucked into the duct 28 through the opening 31 are collected by the filter 27, but partially adhere to the inside of the duct 28. As illustrated in FIGS. 10, 13, 11, and 14, the duct 28 according to the embodiment is attachable to and detachable from the stationary section 32 by being slid along the transport direction A. Therefore, the foreign substances adhering to the duct 28 can be removed by cleaning the duct 28, and the duct 28 can be easily replaced.

The mist collectors 25*a* and 25*b* are configured to sequentially have the stationary section 32, the filter 27, and the duct 28 in the transport direction A, and are configured so that a knob 29 disposed in the filter 27 is visible through a hole 30 disposed in the duct 28. This configuration enables only the duct 28 to be detached from the stationary section 32 as illustrated in FIGS. 10 and 13. In addition, the configuration enables the duct 28 and the filter 27 to be concurrently detached from the stationary section 32 as illustrated in FIGS. 11 and 14.

As described above, the recording device 1 according to the present embodiment has the carriage 6 serving as the base body, the fan 26 serving as the air current generator disposed in the carriage 6, and the opening 31, and includes the duct 28 configuring the air current flow path formed from the opening 31 to the fan 26 and the filter 27 disposed between the opening 31 and the fan 26. Then, the duct 28 is attachable to and detachable from the carriage 6.

Therefore, the recording device 1 according to the embodiment adopts a configuration in which cleaning or replacement can be performed by detaching the duct 28 from the carriage 6 if the foreign substances such as the ink mist are accumulated in the duct 28. Accordingly, it is possible to prevent the recording medium P from becoming dirty due to the foreign substances adhering to the recording medium P.

The base body in the recording device 1 according to the embodiment is the carriage 6 including a recording unit (recording head 4) which performs recording by ejecting the ink, but may be a frame section or an exterior which configures the recording device 1.

As described above, the filter 27 according to the embodiment is attachable to and detachable from the carriage 6.

Therefore, in the recording device 1 according to the embodiment, cleaning or replacement can be performed by detaching the filter 27 from the carriage 6 if the foreign substances such as the ink mist are accumulated in the filter 27.

Accordingly, it is possible to effectively prevent the recording medium P from becoming dirty due to the foreign substances adhering to the recording medium P.

As described above, as illustrated in FIGS. 10 and 13, the recording device 1 according to the embodiment is configured so that the duct 28 can be detached from the carriage 6 prior to the filter 27.

Therefore, in the recording device 1 according to the embodiment, the cleaning or the replacement may be performed by detaching only the filter 27 from the carriage 6, and the cleaning or the replacement is not performed on the duct 28. In this manner, it is possible to prevent the recording medium P from becoming dirty due to the foreign substances such as the ink mist accumulated in the duct 28 adhering to the recording medium P.

However, a configuration may be adopted in which the duct 28 can be detached from the base body prior to the filter 27 and the filter 27 can be detached from the base body prior to the duct 28. In addition, a configuration may be adopted in which the duct 28 can be detached from the base body prior to the filter 27 and the duct 28 and the filter 27 can be concurrently detached from the base body. Furthermore, a configuration may be adopted in which the duct 28 can be detached from the base body prior to the filter 27 and the filter 27 can be detached from the base body prior to the duct 28, and in which the duct 28 and the filter 27 can be concurrently detached from the base body.

On the other hand, a configuration may be adopted in which the filter 27 can be detached from the base body prior to the duct 28.

According to this configuration, it is possible to improve operability in a configuration in which the filter 27 is more likely to become dirty than the duct 28, for example, when the cleaning or the replacement has to be performed on the filter 27 within a shorter time as compared to the duct 28.

In addition, a configuration may be adopted in which the filter 27 can be detached from the base body prior to the duct 28, and the duct 28 and the filter 27 can be concurrently detached from the base body.

As described above, as illustrated in FIGS. 11 and 14, the recording device 1 according to the embodiment adopts a configuration in which the duct 28 and the filter 27 can be concurrently detached from the carriage 6.

Therefore, in the recording device 1 according to the embodiment, operability is improved when the duct 28 and the filter 27 are concurrently detached from the carriage 6.

As described above, as illustrated in FIGS. 7 and 8, the carriage 6 according to the embodiment has the nozzle forming surface F for ejecting the ink onto the recording medium P, and the opening 31 is configured to be substantially flush with the nozzle forming surface F. That is, the carriage 6 includes the recording head 4 having the nozzle forming surface F. The nozzle forming surface F of the recording head 4 and the opening 31 of the duct 28 which are disposed together in the carriage 6 are configured to be substantially flush with each other.

Therefore, in a case where air current flowing from the nozzle forming surface F toward the opening 31 is generated when the carriage 6 is moved in the direction B, the air current is prevented from becoming turbulent flow. Accordingly, the recording medium P is prevented from becoming dirty due to the ink mist adhering to the recording medium P. The ink ejection is prevented from becoming poor due to the ink mist adhering to the nozzle forming surface F.

As a configuration in which the nozzle forming surface F of the recording head 4 and the opening 31 of the duct 28 are flush with each other, a configuration may be adopted in which the opening 31 is not flush with the nozzle forming surface F in a strict sense, as in the carriage 6 according to the present embodiment. For example, a configuration may be adopted in which both of these are deviated from each other to such an extent that the air current does not become turbulent flow when the air current flowing from the nozzle forming surface F toward the opening 31 is generated.

There may be further provided a pressure detector between the filter 27 and the fan 26 serving as the air current generator.

The reason is that according to this configuration, a detection result of the pressure detector enables a user to detect whether the user forgets to attach the filter 27 or to detect the replacement time for the filter 27.

Embodiment 2 (FIGS. 17 to 20C)

Next, a recording device according to Embodiment 2 will be described in detail with reference to the accompanying drawings.

Figure 17:
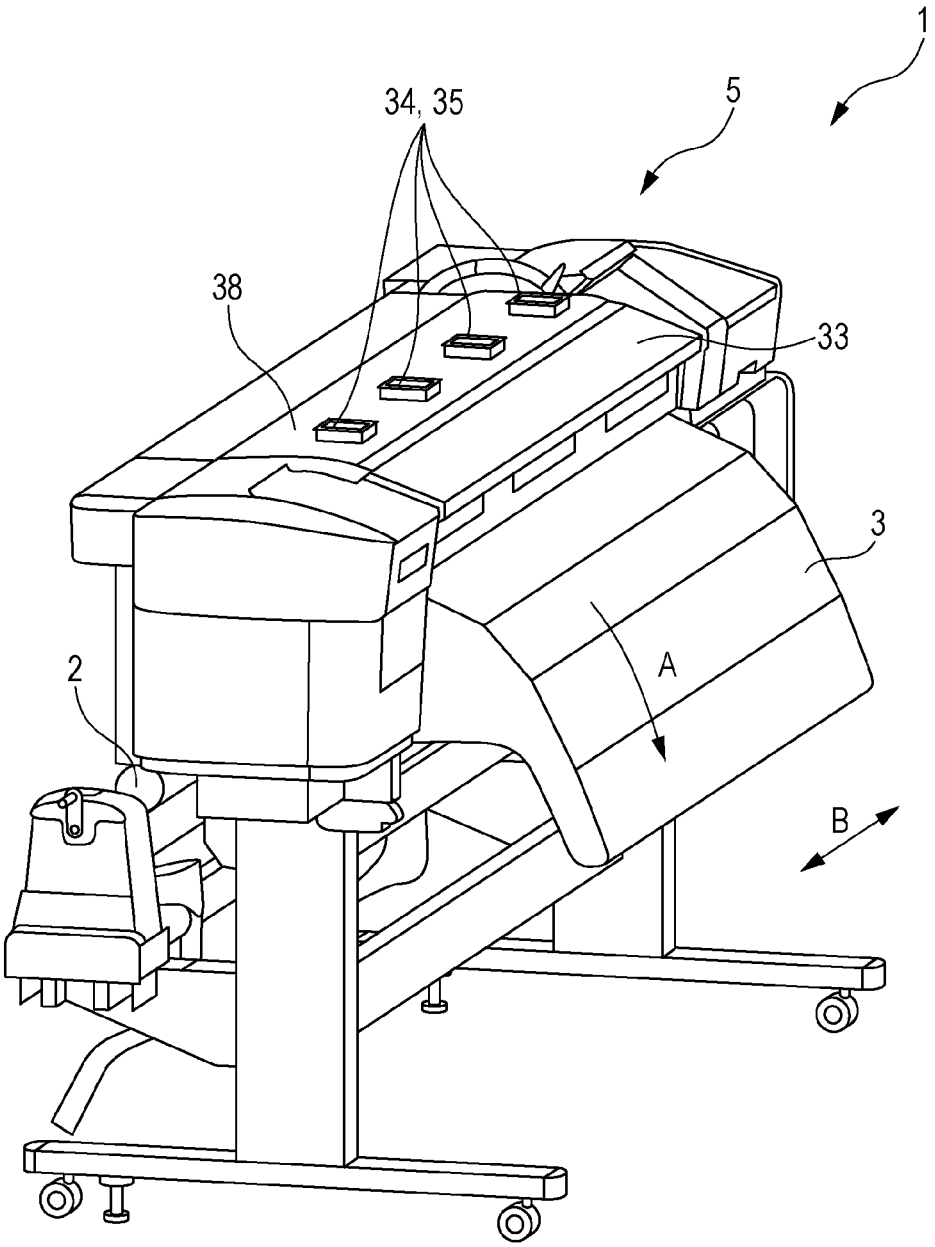
FIG. 17 is a schematic perspective view illustrating a recording device according to Embodiment 2 of the invention.
Figure 18:
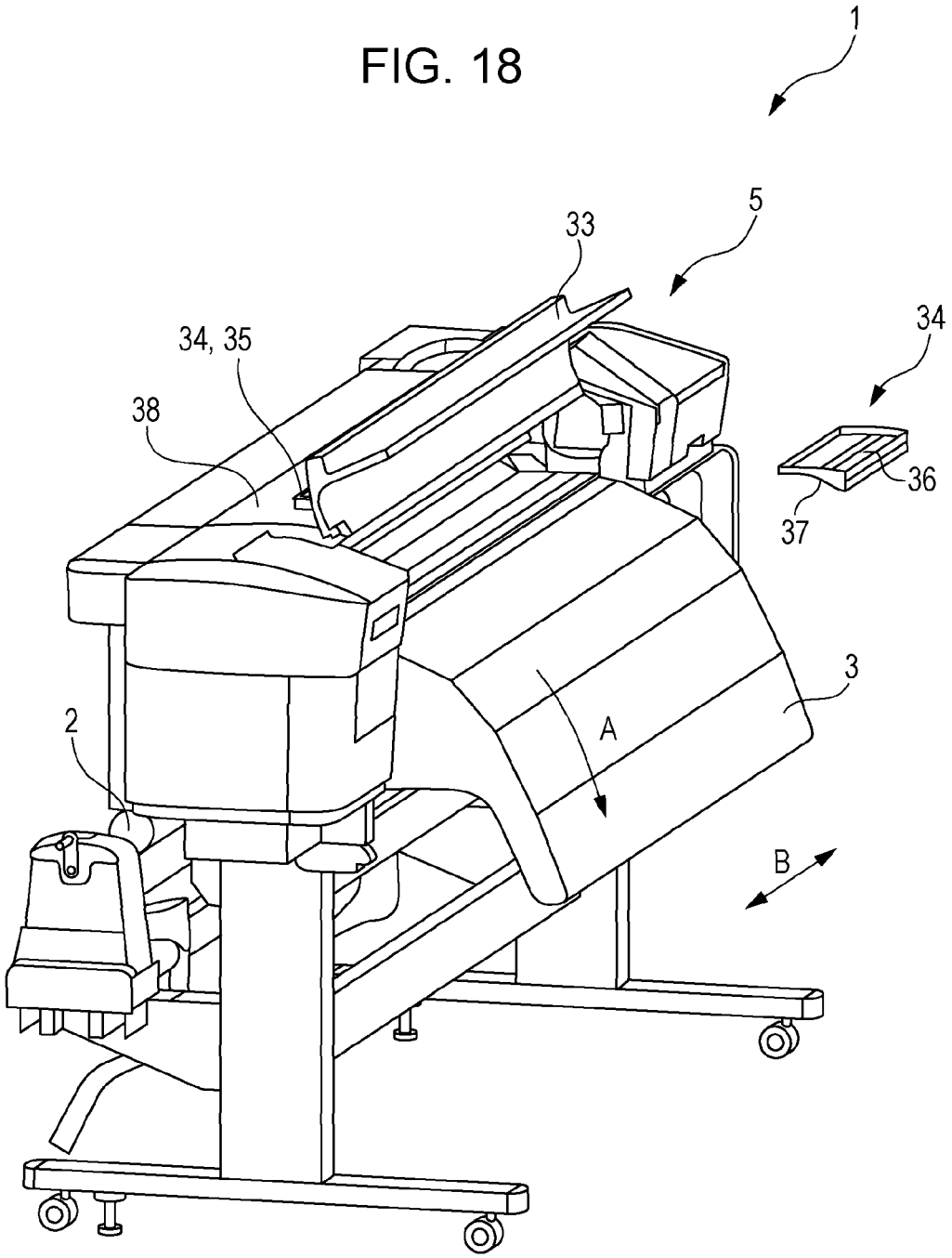
FIG. 18 is a schematic perspective view illustrating the recording device according to Embodiment 2.
Figure 19:
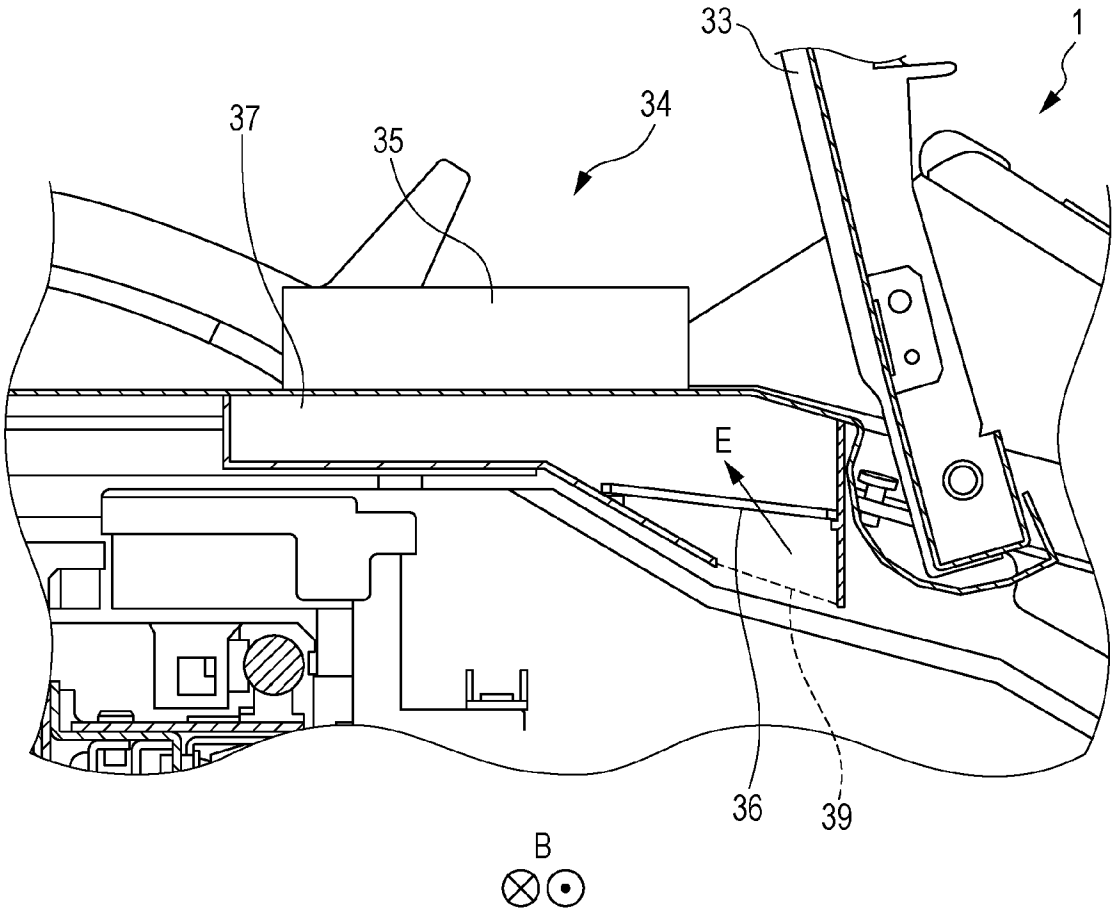
FIG. 19 is a schematic side view illustrating a mist collector of the recording device according to Embodiment 2.
Figure 20A:
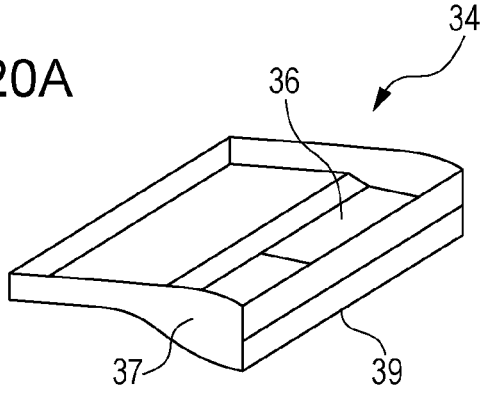
FIGS. 20A to 20C are schematic perspective views illustrating the mist collector of the recording device according to Embodiment 2.
Figure 20B:
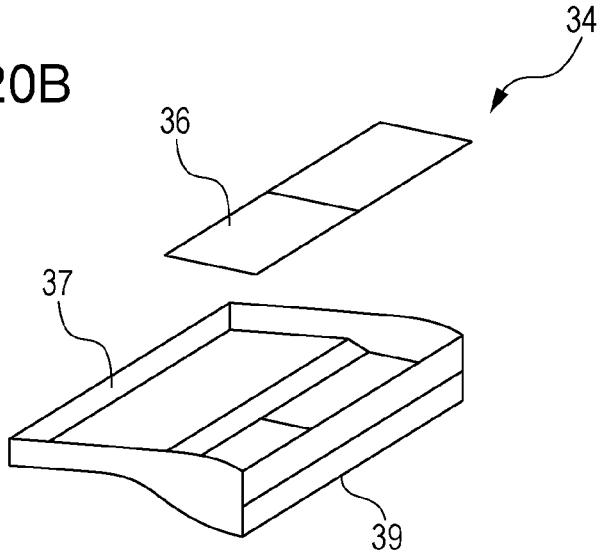
Figure 20C:
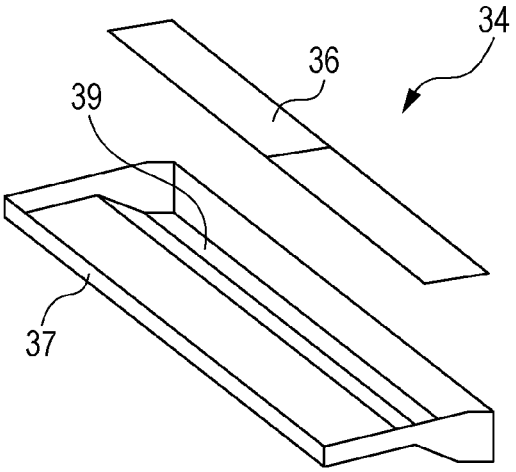

FIGS. 17 and 18 are schematic perspective views of the recording device 1 according to the embodiment. FIG. 17 illustrates a state where a cover 33 is closed, and FIG. 18 illustrates a state where a filter 36 and a duct 37 which configure one mist collector 34 are detached by opening the cover 33. In addition, FIG. 19 is a schematic side view of the mist collector 34 according to the embodiment. FIGS. 20A to 20C are schematic perspective views of the mist collector 34 according to the embodiment. FIG. 20A illustrates a state where the filter 36 forms a set with the duct 37, and FIGS. 20B and 20C illustrate a state where the filter 36 is detached from the duct 37. The same reference numerals are given to configuration members which are the same as those in the above-described embodiment, and detailed description thereof will be omitted.

In the recording device 1 according to the embodiment, the winding shaft 10 and the tension bar 9 are detached in FIGS. 17 and 18. However, the recording device 1 according to the embodiment has the same configuration as that of the recording device 1 according to Embodiment 1 except that the mist collector 34 is disposed in an exterior 38 of the recording device 1 instead of the mist collector 25 being disposed in the carriage 6.

As illustrated in FIG. 17, in the recording device 1 according to the embodiment, four mist collectors 34 are disposed in the exterior 38 along the direction B. All of these mist collectors 34 have the same configuration, and have a fan 35 fixed to the exterior 38 serving as a base body, and the filter 36 and the duct 37 which are attachable to and detachable from the exterior 38.

The filter 36 and the duct 37 according to the embodiment are attachable to and detachable from the recording device 1 as illustrated in FIGS. 18 and 19 in a state where the filter 36 forms a set with the duct 37 as illustrated in FIG. 20A.

As illustrated in FIGS. 20A to 20C, similarly to the duct 28, the duct 37 has an opening 39, and is configured so that a suction force generated by the fan 35 can suck the ambient air through the opening 39. Then, as illustrated in FIG. 19, the filter 36 is arranged between the opening 39 and the fan 35 in an air current flow path formed in a direction E where the suction force generated by the fan 35 generates air current inside the duct 35.

According to this configuration, similarly to the recording device 1 of Embodiment 1, the recording device 1 of the embodiment can prevent the recording medium P from becoming dirty due to foreign substances such as ink mist adhering to the recording medium P.

The invention is not limited to the above-described embodiments, and can be modified in various ways within the scope of the invention described herein. As a matter of course, the modifications are also included in the scope of the invention.

For example, in both the recording devices 1 according to Embodiment 1 and Embodiment 2, the filter is disposed in the mist collector, but the recording device may be configured so as not to include the filter.

Hitherto, the invention has been described in detail with reference to the specific embodiments. Here, the outline of the invention will be described again.

The recording device 1 according to an aspect of the invention has base bodies 6 and 38, the air current generators 26 and 35 which are disposed in the base bodies 6 and 38, and openings 31 and 39, and includes the ducts 28 and 37 which configure the air current flow paths formed from the openings 31 and 39 to the air current generators 26 and 35. The ducts 28 and 37 are attachable to and detachable from the base bodies 6 and 38.

Here, the meaning of the "base body" also includes the carriage provided with the recording unit for performing recording by ejecting the ink in addition to the frame section or the exterior which configures the recording device 1.

In this case, the ducts 28 and 37 are attachable to and detachable from the base bodies 6 and 38.

Therefore, cleaning or replacement can be performed by detaching the ducts 28 and 37 from the base bodies 6 and 38 if foreign substances such as ink mist are accumulated in the ducts 28 and 37. Accordingly, it is possible to prevent the recording medium P from becoming dirty due to the foreign substances adhering to the recording medium P.

The recording device 1 according to the aspect of the invention includes the filters 27 and 36 which are disposed between the openings 31 and 39 and the air current generators 26 and 35. The filters 27 and 36 are attachable to and detachable from the base bodies 6 and 38.

In this case, the filters 27 and 36 are attachable to and detachable from the base bodies 6 and 38. Therefore, cleaning or replacement can be performed by detaching the filters 27 and 36 from the base bodies 6 and 38 if foreign substances such as ink mist are accumulated in the filters 27 and 36. Accordingly, it is possible to effectively prevent the recording medium P from becoming dirty due to the foreign substances adhering to the recording medium P.

The recording device 1 according to the aspect of the invention adopts a configuration in which the ducts 28 and 37 can be detached from the base bodies 6 and 38 prior to the filters 27 and 36.

In this case, a configuration is adopted in which the ducts 28 and 37 can be detached from the base bodies 6 and 38 prior to the filters 27 and 36. Accordingly, cleaning or replacement is performed by detaching only the filters 27 and 36 from the base bodies 6 and 38, and the cleaning or the replacement is not performed on the ducts 28 and 37. In this manner, it is possible to prevent the recording medium P from becoming dirty due to the foreign substances such as the ink mist accumulated in the ducts 28 and 37 adhering to the recording medium P.

The recording device 1 according to the aspect of the invention adopts a configuration in which the filters 27 and 36 can be detached from the base bodies 6 and 38 prior to the ducts 28 and 37.

In this case, a configuration is adopted in which the filters 27 and 36 can be detached from the base bodies 6 and 38 prior to the ducts 28 and 37. Therefore, it is possible to improve operability in a configuration in which the filters 27 and 36 are more likely to become dirty than the ducts 28 and 37, when the cleaning or the replacement has to be performed on the filters 27 and 36 within a shorter time as compared to the ducts 28 and 37.

The recording device 1 according to the aspect of the invention adopts a configuration in which the ducts 28 and 37 and the filters 27 and 36 can be concurrently detached from the base bodies 6 and 38.

In this case, a configuration is adopted in which the ducts 28 and 37 and the filters 27 and 36 can be concurrently detached from the base bodies 6 and 38. Therefore, it is possible to improve operability when the ducts 28 and 37 and the filters 27 and 36 are concurrently detached from the base bodies 6 and 38.

The recording device 1 according to the aspect of the invention adopts a configuration in which the base body 6 has the nozzle forming surface F for ejecting the ink onto the recording medium P and the opening 31 is flush with the nozzle forming surface F.

In this case, a configuration is adopted in which the opening 31 is flush with the nozzle forming surface F. That is, the base body 6 includes the recording unit 4 having the nozzle forming surface F. The nozzle forming surface F of the recording unit 4 and the opening 31 of the duct 28 which are disposed together in the base body 6 are configured to be flush with each other. Therefore, when air current flowing from the nozzle forming surface F toward the opening 31 is generated, it is possible to prevent the air current from becoming turbulent flow. Accordingly, it is possible to prevent the recording medium P from becoming dirty due to the ink mist adhering to the recording medium P. It is possible to prevent the ink ejection from becoming poor due to the ink mist adhering to the nozzle forming surface F.

The meaning of "the opening 31 is configured to be flush with the nozzle forming surface F" includes not only a configuration in which the opening 31 is flush with the nozzle forming surface F in a strict sense, but also a configuration in which both of these are deviated from each other to such an extent that the air current does not become turbulent flow when the air current flowing from the nozzle forming surface F toward the opening 31 is generated.

The recording device 1 according to the aspect of the invention includes the pressure detector between the filters 27 and 36 and the air current generators 26 and 35.

In this case, there is provided the pressure detector between the filters 27 and 36 and the air current generators 26 and 35. The detection result of the pressure detector enables a user to detect whether the user forgets to attach the filters 27 and 36 or to detect the replacement time for the filters 27 and 36.

The entire disclosure of Japanese Patent Application No. 2014-057879, filed Mar. 20, 2014 is expressly incorporated reference herein

What is claimed is:

1. A recording device comprising:

a reciprocating base body;

an air current generator that is disposed in the base body and attachable to and detachable from the base body; and a duct that has an opening and configures an air current flow path formed from the opening to the air current generator, wherein the duct is slidably attachable to and detachable from the base body independently from attachment and detachment of the air current generator and with a position of the air current generator coupled to the base body being the same with the duct attached and detached.

2. The recording device according to claim 1, further comprising:

a filter that is disposed between the opening and the air current generator, wherein the filter is attachable to and detachable from the base body.

3. The recording device according to claim 2, wherein the duct can be detached from the base body while the filter is positioned adjacent the air current generator.

4. The recording device according to claim 2, wherein the filter can be detached from the base body while the duct is mounted to the base body.

5. The recording device according to claim 2, wherein the duct and the filter can be concurrently detached from the base body.

6. The recording device according to claim 1, wherein the base body has a nozzle forming surface which ejects an ink onto a recording medium, and wherein the opening is positioned relative to the nozzle forming surface to prevent air current from the nozzle forming surface to the opening becoming turbulent flow.

* * * * *